US008210503B2

(12) United States Patent
Garrison

(10) Patent No.: US 8,210,503 B2
(45) Date of Patent: Jul. 3, 2012

(54) FENCE PANEL INTERLOCK

(75) Inventor: Dondi D. Garrison, Cullman, AL (US)

(73) Assignee: Flotation Systems, Inc., Cullman, AL (US)

( * ) Notice: Subject to any disclaimer, the term of this patent is extended or adjusted under 35 U.S.C. 154(b) by 410 days.

(21) Appl. No.: 12/368,767

(22) Filed: Feb. 10, 2009

(65) Prior Publication Data

US 2010/0200824 A1 Aug. 12, 2010

(51) Int. Cl.
*E04B 2/00* (2006.01)

(52) U.S. Cl. ..... 256/24; 52/588.1

(58) Field of Classification Search ..... 256/19, 256/21, 24; 403/339; 52/574, 588.1, 589.1, 52/592.1

See application file for complete search history.

(56) References Cited

U.S. PATENT DOCUMENTS

| | | | | |
|---|---|---|---|---|
| 2,877,600 | A | 3/1959 | Slate | |
| 3,100,556 | A | 8/1963 | De Ridder | |
| 3,110,371 | A | 11/1963 | De Ridder | |
| 3,186,525 | A * | 6/1965 | Gresham et al. | 52/792.1 |
| 3,368,315 | A * | 2/1968 | Thurnau | 52/588.1 |
| 3,402,526 | A | 9/1968 | Baxter | |
| 3,555,762 | A | 1/1971 | Costanzo, Jr. | |
| 3,606,718 | A | 9/1971 | Curran | |
| 3,759,007 | A | 9/1973 | Thiele | |
| 3,813,839 | A | 6/1974 | Simpson, Jr. et al. | |
| 4,099,358 | A | 7/1978 | Compaan | |
| 4,306,631 | A * | 12/1981 | Reusser | 256/24 |
| 4,546,590 | A | 10/1985 | Finch et al. | |
| 4,631,891 | A * | 12/1986 | Donavich | 52/588.1 |
| 4,819,398 | A | 4/1989 | Dameron | |
| 4,870,798 | A | 10/1989 | Richter | |
| 5,185,193 | A * | 2/1993 | Phenicie et al. | 52/588.1 |
| 5,529,289 | A | 6/1996 | Lancer, Sr. | |
| 5,725,201 | A | 3/1998 | Parth | |
| 5,791,093 | A | 8/1998 | Diamond | |
| 5,816,010 | A | 10/1998 | Conn | |
| 5,842,545 | A | 12/1998 | Blaiotta | |
| 6,226,950 | B1 | 5/2001 | Davis | |
| 6,260,828 | B1 | 7/2001 | English | |

(Continued)

FOREIGN PATENT DOCUMENTS

| | | |
|---|---|---|
| EP | 0338663 | 10/1989 |

(Continued)

OTHER PUBLICATIONS

"Extruded Aluminum Interlocking Walls," Esther Williams Above Ground Aluminum Pools, © 1997-2007 Pools and Spas Online, found at http://www.poolsandspasonline.com/html/carousel_round.html, printed on Mar. 26, 2008, 2 pages.

(Continued)

*Primary Examiner* — Michael P Ferguson
(74) *Attorney, Agent, or Firm* — Angela Holt; Bradley Arant Boult Cummings LLP

(57) ABSTRACT

A plurality of interlocking panels is provided. A panel assembly comprises a plurality of generally rectangular panel members assembled in interlocking relationship. Each panel member has a substantially flat planar main body and two side edges that interconnect with adjacent panel members. After the panels are interlocked together, the interlocking components on the inner walls of the side edges are covered by the smooth outer walls of the side edges. The panels may be used to fabricate a fence.

5 Claims, 6 Drawing Sheets

U.S. PATENT DOCUMENTS

| | | | |
|---|---|---|---|
| 6,314,698 | B1 | 11/2001 | Johansson |
| 6,877,721 | B2 | 4/2005 | Calverley |
| 6,939,422 | B2 | 9/2005 | Moulin et al. |
| 7,021,012 | B2 | 4/2006 | Zeng et al. |
| 2006/0196147 | A1 | 9/2006 | Dickey |

FOREIGN PATENT DOCUMENTS

| | | |
|---|---|---|
| EP | 0392923 | 10/1990 |
| GB | 2049008 | 12/1980 |
| JP | 2001173163 | 6/2001 |

OTHER PUBLICATIONS

"How LockDry® Aluminum Decking Works," LockDry Aluminum Decking Information, © 2006 FSI Home Products Division—LockDry® Aluminum Decking, found at http://www.lockdry.com/decking_info.htm, printed on Mar. 10, 2008, one page.

"Welcome to RailingWorksTM Aluminum Railing Systems," Aluminum Railings by RailingWorks, © 2005 FSI Home Products Division, found at http://www.railingworks.com/, printed on Mar. 10, 2008, one page.

"Welcome to ProWayTM Aluminum Fence & Gates," ProWay Aluminum Fence and Gates, © 2006 FSI Home Products Division, found at http://www.prowayfence.com, printed on Mar. 10, 2008, one page.

"Welcome to Flotation Systems, Inc.," Aluminum Boat Docks and Dock Accessories from Flotation Systems, Inc., © 2005 Flotation Systems, Inc. Aluminum Boat Docks, found at http://www.aluminumboatdocks.com/, printed on Mar. 10, 2008, one page.

"Trex Seclusions® Privacy Fencing Components Animation," Trex Seclusions® Privacy Fencing: Product Benefits and Colors—Raise Property Value—Promise Pri . . . , © 1997-2008 Trex Company, Inc., found at http://www.trex.com/fencing/default.aspx, printed on Mar. 9, 2008, 3 pages.

"Trex Seclusions® Privacy Fencing Designer Series Railing: Gallery 1 of 22," Trex Seclusions® Privacy Fencing: Product Benefits and Colors—Raise Property Value—Promise Pri . . . , found at http://www.trex.com/fencing/default.aspx, printed on Mar. 9, 2008, one page.

"Trex Seclusions® Privacy Fencing Designer Series Railing: Gallery 10 of 22," Trex Seclusions® Privacy Fencing: Product Benefits and Colors—Raise Property Value—Promise Pri . . . , found at http://www.trex.com/fencing/default.aspx, printed on Mar. 9, 2008, one page.

* cited by examiner

Detail A

Detail B

FENCE PANEL INTERLOCK

FIELD OF THE INVENTION

The present invention relates generally to the field of fences, and more specifically to the field of interlocking fence panels.

BACKGROUND AND SUMMARY OF THE INVENTION

A fence constructed of interlocking fence panels is provided. A panel assembly comprises a plurality of generally rectangular panel members assembled in interlocking relationship. Each panel member has a substantially flat planar main body and two side edges that interconnect with adjacent panel members. After the panels are interlocked together, the interlocking components on the inner walls of the side edges are covered by the smooth outer walls of the side edges.

BRIEF DESCRIPTION OF THE DRAWINGS

The present invention is described with reference to the accompanying drawings. In the drawings, like reference numbers indicate identical or functionally similar elements.

DETAILED DESCRIPTION

Figure 1:
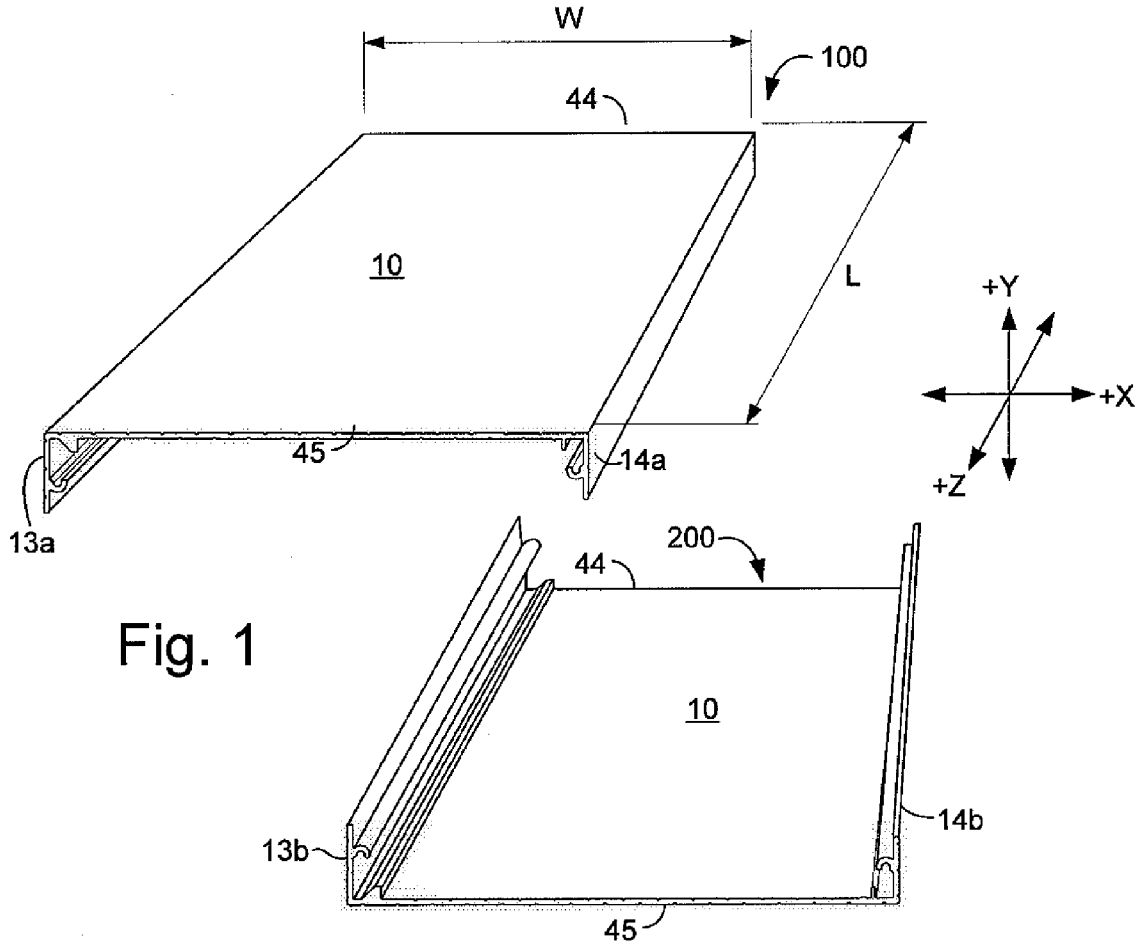
FIG. 1 depicts a first and second fence panel member according to an embodiment of the present disclosure.

The present invention and its advantages are best understood by referring to the drawings. The elements of the drawings are not necessarily to scale, emphasis instead being placed upon clearly illustrating the principles of the invention.

FIG. 1 depicts a perspective view of a first panel member 100 and a second panel member 200, each of which panel members is comprised of an identical fence panel 10. In this regard, the second panel member 200 is flipped and rotated such that it is mateable with the first panel member 100, as further discussed herein.

The first panel member 100 comprises a first ramping edge 13*a* and a first restraining edge 14*a*. The second panel member 200 comprises a second ramping edge 13*b* and a second restraining edge 14*b*. The first ramping edge 13*a* is substantially similar to the second ramping edge 13*b*, and the first restraining edge 14*a* is substantially similar to the second restraining edge 14*b*. The first restraining edge 14*a* is mateable with the second ramping edge 13*b* to connect the first and second panel members 100 and 200 together, as further discussed herein. A ramping edge (not shown) of a subsequent panel member (not shown) is mateable with the restraining edge 14*b* of the second panel member 200. In this manner, a plurality of panel members may be connected together to form a fence (not shown) or other similar structure.

Each of the panel members 100 and 200 is rectangularly shaped in the illustrated embodiment and has a straight top edge 44 and bottom edge 45, a length "L" and a width "W." The lengths "L" may be any length desired by a user, and in one embodiment is six feet long for a standard privacy fence. The width "W" may be any width, and in one embodiment is substantially 6.35 inches wide.

Figure 2:
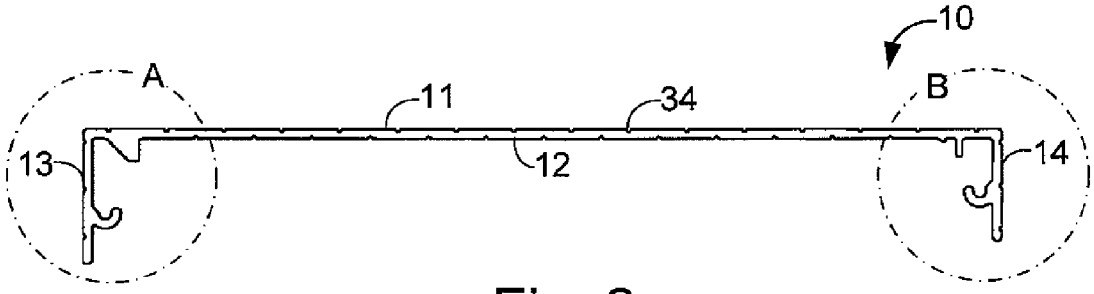
FIG. 2 is cross-sectional view of a fence panel member according to according to the embodiment depictured in FIG. 1.

FIG. 2 depicts a cross-sectional view of the fence panel 10 according to an embodiment of the present disclosure. The panel 10 comprises a generally squared off "C"-shaped panel with an outer panel surface 11, an inner panel surface 12, a ramping edge 13 that forms one "leg" of the C-shape, and a restraining edge 14 that forms the other "leg" of the C-shape. (Refer to FIGS. 3 and 4 for a more detailed view of the edges 13 and 14.) The cross-section as illustrated is generally uniform for the length of the panel 10. In one embodiment, the panel 10 is fabricated from extruded aluminum, though other materials and processes could be used. In one embodiment, the wall thickness of the panel is 0.065 inches.

The ramping edge 13 and the restraining edge 14 extend generally perpendicularly from the panel inner panel surface 12. The ramping edge 13 extends from the panel 10 generally further than the restraining edge extends, and in one embodiment the ramping edge extends 0.914 inches and the restraining edge extends 0.755 inches.

In the illustrated embodiment, the panel 10 further comprises recesses 34 which are indentations in the outer surfaces of the panel. The recesses 34 add texture to the panel 10 to simulate a wood finish.

Figure 3:
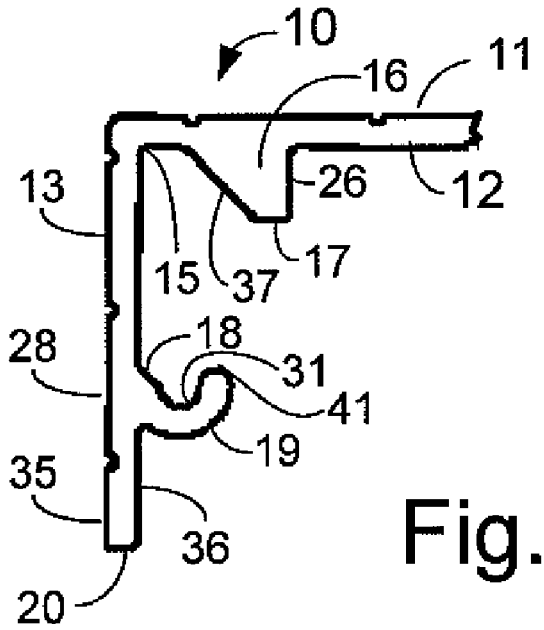
FIG. 3 is an enlarged detail view taken along detail view "A" of FIG. 1.

FIG. 3 depicts an enlarged cross-sectional view of the ramping edge 13 of the panel 10, and more specifically the portion of the panel 10 designated as detail "A" in FIG. 2. The ramping edge 13 of the panel 10 comprises a leg 35 that extends the length "L" (FIG. 1) of the panel 10 substantially perpendicularly from the inner panel surface 12. The leg 35 has an outer surface 28, an inner surface 36, an outside edge 20, a hook portion 19, an inner corner 15, and a ramp portion 16. The outer surface 28 comprises a generally flat surface that is substantially perpendicular to the inner panel surface 12. The outer surface 28 further comprises recesses 34 that add texture to the panel 10.

The outside edge 20 comprises a generally flat surface that extends down the length of the panel 10. The outside edge 20 is substantially parallel to the inner panel surface 12.

The hook portion 19 extends from the inner surface 36 of the leg 35 and also extends the length "L" (FIG. 1) of the panel 10. The hook portion 19 is substantially semi-circular and is concavely oriented toward the outer panel surface 11. The hook portion 19 comprises an inner hook surface 31 and an angled portion 18. The inner hook surface 31 is a concavely rounded surface that mates with the restraining edge 14 (FIG. 4) of another panel 10, as further discussed herein. The angled portion 18 is a surface that transitions from the inner surface 36 of the leg 35 to the inner hook surface 31, as further discussed herein.

The corner 15 is disposed at the juncture of the inner surface 12 of the panel 10 and the inner surface 36 of the leg 35. The ramp 16 comprises a ramping surface 37 that extends at an angle from the inner surface 12 of the panel 10. The ramping surface 37 terminates at a platform 17. The platform 17 is substantially parallel to the inner surface 12 of the panel 10. A wall 26 extends substantially perpendicularly to the inner surface 12 of the panel 10 and joins the inner surface 12 to the platform 17.

Figure 4:
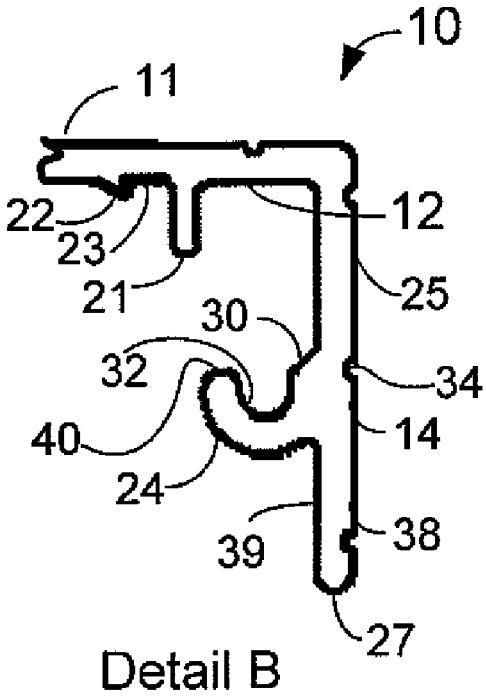
FIG. 4 is an enlarged detail view taken along detail view "B" of FIG. 1

FIG. 4 depicts an enlarged cross-sectional view of the restraining edge 14 of the panel 10, and more specifically the portion of the panel 10 designated as detail "B" in FIG. 2. The restraining edge 14 comprises a leg 38 that extends the length "L" (FIG. 1) of the panel 10 substantially perpendicularly from the inner panel surface 12. The leg 38 has an outer surface 25, an inner surface 39, an outside edge 27, a hook portion 24, a ledge wall 21, and a wall stop 22. The outer surface 25 comprises a generally flat surface that is substantially perpendicular to the inner panel surface 12. The outer surface 25 further comprises recesses 34 that add texture to the panel 10.

The outside edge 27 comprises a generally flat surface that extends the length "L" (FIG. 1) of the panel 10. The outside edge 27 is substantially parallel to the inner panel surface 12.

The hook portion 24 extends from the inner surface 39 of the leg 38 and also extends the length "L" (FIG. 1) of the panel 10. The hook portion 24 is semi-circular and is concavely oriented towards the outer panel surface 11. The hook portion 24 comprises an inner hook surface 32 and an angled portion 30. The inner hook surface 32 is a concavely rounded surface that mates with the inner hook surface 31 (FIG. 3) of the ramping edge 13 (FIG. 3). The angled portion 30 is a surface that transitions from the inner surface 39 of the leg 38 to the inner hook surface 32, as further discussed herein.

The ledge wall 21 extends substantially perpendicularly from the inner surface 12 of the panel 10 and extends the length "L" (FIG. 1) of the panel 10. The wall stop 22 extends at an angle from the inner surface 12 of the panel and defines a recess 23 between the wall stop 22 and the ledge wall 21.

Figure 5:
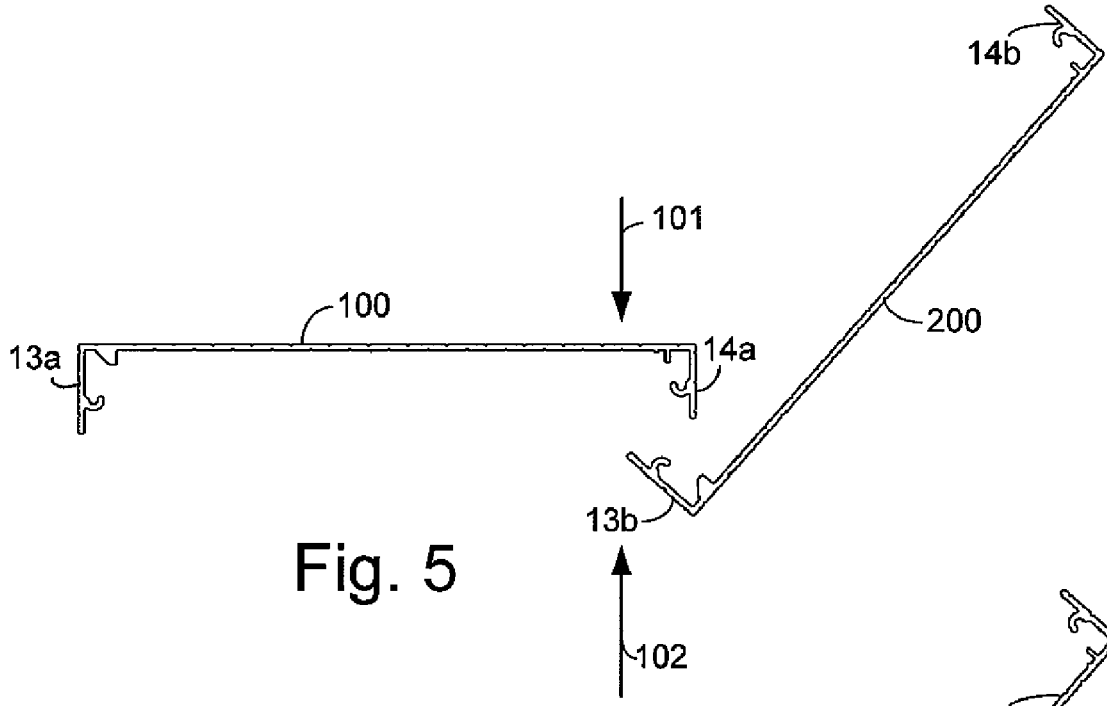
FIG. 5 is a cross-sectional view of the first and second fence panel members of FIG. 1 as the members are entering a position to be joined together.

FIGS. 5-10 illustrate the mating of the two panel members 100 and 200. FIG. 5 depicts a cross-sectional view of the first panel member 100 and the second panel member 200 just prior to mating of the two panels together. In assembly, a user (not shown) moves the restraining edge 14*a* of the first panel member 100 toward the second panel member 200 in the direction indicated by directional arrow 101, and moves the ramping edge 13*b* of the second panel member 200 toward the restraining edge of the first panel member 100 in the direction indicated by directional arrow 102.

Figure 6:
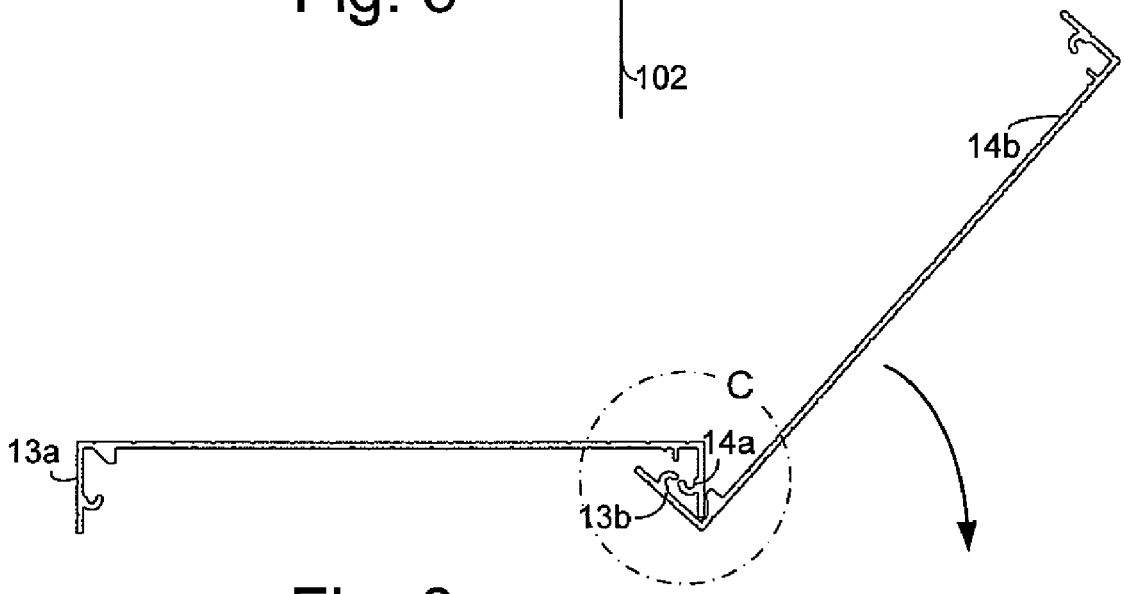
FIG. 6 is a cross-sectional view of the first and second fence panel members of FIG. 5 as they are coming into contact with one another.

FIG. 6 depicts a cross-sectional view of the first panel member 100 contacting the second panel member 200 prior to mating of the two panels. In this regard, the restraining edge 14*a* of the first panel member 100 is in contact with the ramping edge 13*b* of the second panel member 200.

Figure 7:
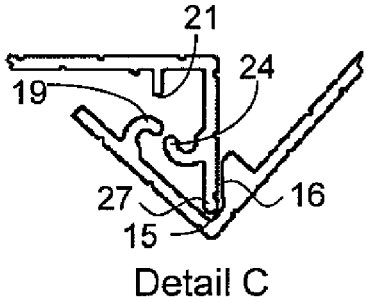
FIG. 7 is an enlarged detail view taken along detail view "C" of FIG. 6.
Figure 8:
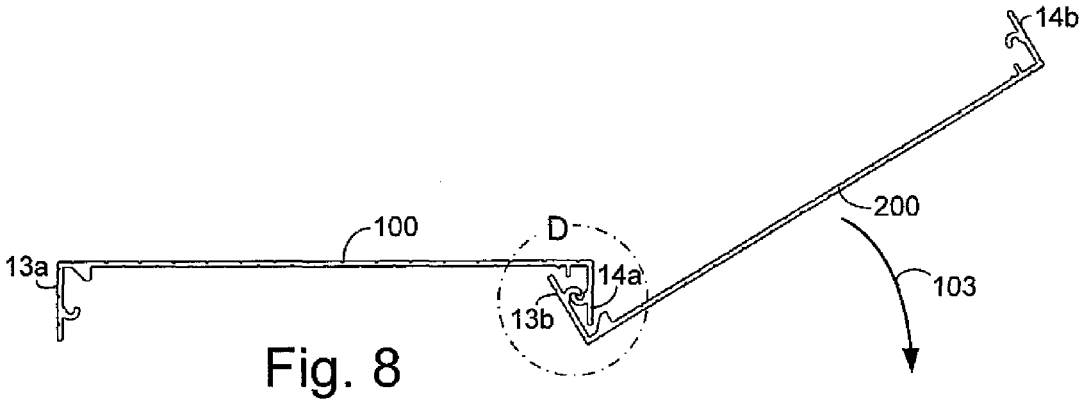
FIG. 8 is a cross-sectional view of the first and second fence panel members of FIG. 6 as they are being further joined together.
Figure 9:
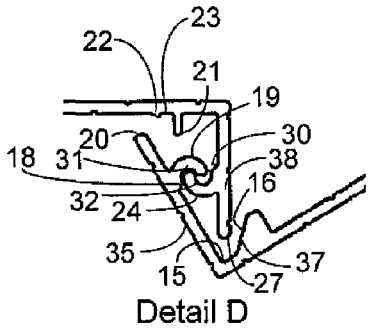
FIG. 9 is an enlarged detail view taken along detail view "D" of FIG. 8.

FIG. 7 depicts an enlarged view of the contacting portions of panel members 100 and 200 as illustrated in FIG. 6, and more specifically the portions of the panel members 100 and 200 designated as detail "C." The outside edge 27 of the leg 38 on the panel member 100 is positioned adjacent the corner 15 of the ramping edge of the panel member 200. This position allows the hook portion 24 of the first panel member 100 the clearance to mate with the hook portion 19 of the second member 200 (as shown in FIGS. 8 and 9). After the first and second panel members 100 and 200 are in the position illustrated in FIG. 6, the second panel member 200 may be rotated in the direction indicated by reference arrow 103 to continue the mating process.

FIG. 8 depicts a cross-sectional view of the first panel member 100 further connecting to the second panel member 200. FIG. 9 depicts an enlarged view of the contacting ends of panel members 100 and 200 as illustrated in FIG. 8, and more specifically the portions of the panel members 100 and 200 designated as detail "D." In this illustration, the hook portion 24 of the first panel member 100 and the hook portion 19 of the second panel member 200 are engaged. Specifically, the inner surface 32 of the hook portion 24 of the first panel member 100 is engaged with the inner surface 31 of the hook portion 19 of the second panel member 200.

The angled portion 30 of the leg 38 and the angled portion 18 of the leg 35 facilitate the mating of the hook portions 19 and 24. In this regard, the outermost edge 41 (FIG. 3) of the hook portion 19 may engage with and slide upon the angled portion 30 of the leg 38. Similarly the outermost edge 40 (FIG. 4) of the hook portion 24 may engage with and slide upon the angled portion 18 of the leg 35. Thus, the angled portions 18 and 30 guide and direct the outermost edges 40 and 41, respectively, so that the surfaces 31 and 32 engaged.

Referring to FIGS. 8 and 9, the second panel member 200 is then further rotated in the direction of reference indicator 103. The outside edge 27 of the leg 38 may then engage with and slide upon the ramping surface 37 of the ramp 16.

Rotating the second panel member 200 will cause the outside edge 20 of the leg 35 to move toward the ledge wall 21, as shown in FIG. 9. When the outside edge 20 reaches the wall stop 22, it will engage with and slide up on an angled, ramped surface (not shown) of the wall stop 22 until it "rides over" the wall stop and comes to rest in the recess 23 between the wall stop 22 and the ledge wall 21. Simultaneously, the rotation of the second panel member 200 causes the outside edge 27 to "travel up" the ramping surface 37 of the ramp 16 until the outside edge 27 rests on the platform 17.

Figure 10:
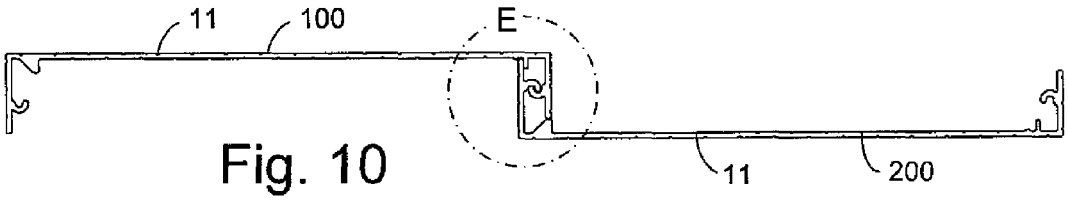
FIG. 10 is a cross-sectional view of the first and second fence panel members of FIG. 8 in a fully engaged position.
Figure 11:
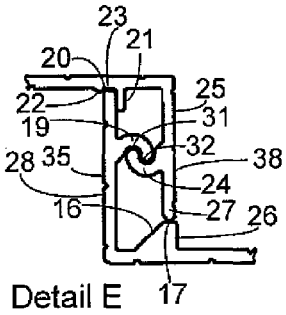
FIG. 11 is an enlarged detail view taken along detail view "E" of FIG. 10.

When the second panel member 200 has been rotated such that its outer panel surface 11 is substantially parallel to the outer panel surface 11 of the first panel member 100, the mating of the two panels is complete, as illustrated in FIGS. 10 and 11. In this fully engaged position, the hook portions 19 and 24 are engaged and the outside edge 20 of the leg 35 is restrained between the wall stop 22 and the ledge wall 21, as illustrated in the enlarged view of FIG. 11. The outside edge 27 of the leg 38 is resting atop the platform 17, and the legs 35 and 38 are substantially parallel.

When the two panel members 100 and 200 are in this fully engaged position, the outside surface 28 of the leg 35 of the second panel member 200 forms a wall substantially perpendicular to the inner surface 12 of the first member 100. Further, the combination of the outside surface 25 of the leg 38 of the first panel member and the rear wall 26 of the ramp 16 forms a wall substantially perpendicular to the inner surface 12 of the second member 200. In this regard, the rear wall 26 of the ramp 16 is substantially parallel and substantially in line with the outside surface 25 of the leg 38, forming a substantially smooth wall.

Figure 12:
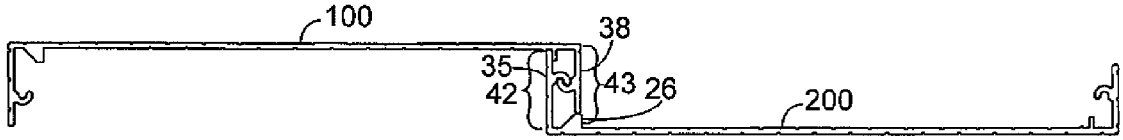
FIG. 12 is a cross-sectional view of the first and second fence panel members of FIG. 10 in the fully engaged position.

Thus when the panel members 100 and 200 are joined, the outside surface of the leg 35 forms what is effectively a smooth inner wall 42 for panel member 100, as illustrated in FIG. 12. Similarly, when the panel members 100 and 200 are joined, the outside surface 25 of leg 38 and the rear wall 26 of the ramp 16 form what is effectively a smooth inner wall 43 for panel member 200. Further, the inner walls 42 and 43 hide the "mechanics" of the joint between the panel members 100 and 200, creating a smooth wall.

Figure 13:
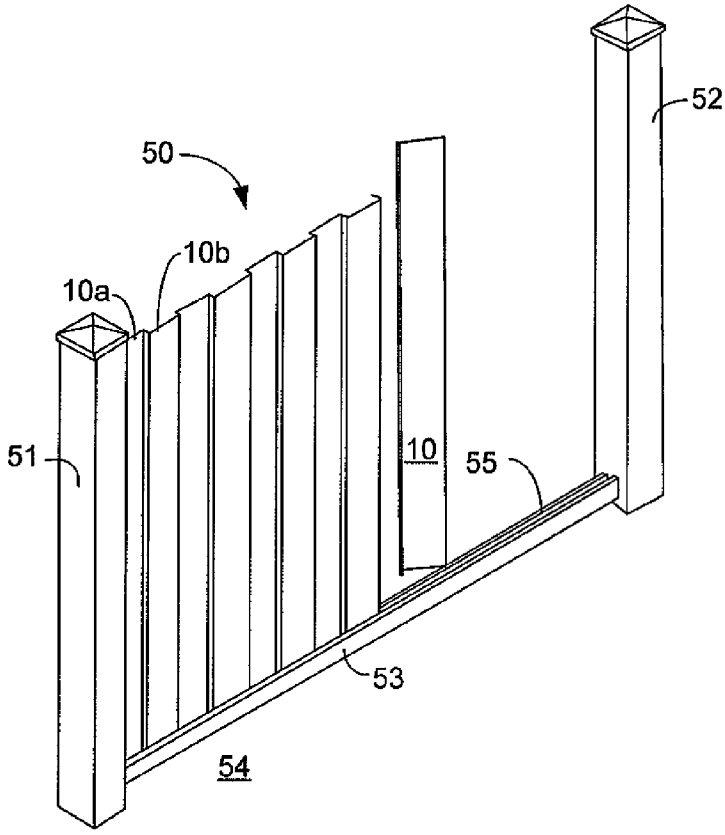
FIG. 13 is a perspective view of a partial fence portion comprised of a plurality of panel members according to an embodiment of the present disclosure.

FIG. 13 depicts a partially-built fence portion 50 constructed using a plurality of interlocking panels 10 according to the present disclosure. Fence posts 51 and 52 are installed into a foundation 54, which may be earthen or comprised of concrete or some other composition known in the art or future developed to be suitable for the support of a fence. In one embodiment, post holes (not shown) are dug or otherwise created in the foundation 54 and a portion of the fence posts 51 and 52 are deposited within the post hole. Alternatively, the fence portion 50 may be free standing by using any number of support means well known in the art.

The fence posts 51 and 52 are spaced apart from one another and a bottom stringer 53 is connected between the vertical posts 51 and 52 to provide a base for the interlocking panels 10. The bottom stringer 53 comprises a slot 55 to receive the interlocked panels 10. To install the panels 10, a first panel 10*a* is slid into the slot 55 in the bottom stringer 53 and affixed to the post 51 via any manner known in the art. A second panel 10*b* is interlocked with panel 10*a* in the manner discussed above, and is then slid into the slot 55 in the bottom stringer 53. Adjacent panels 10 are similarly installed.

Figure 14:
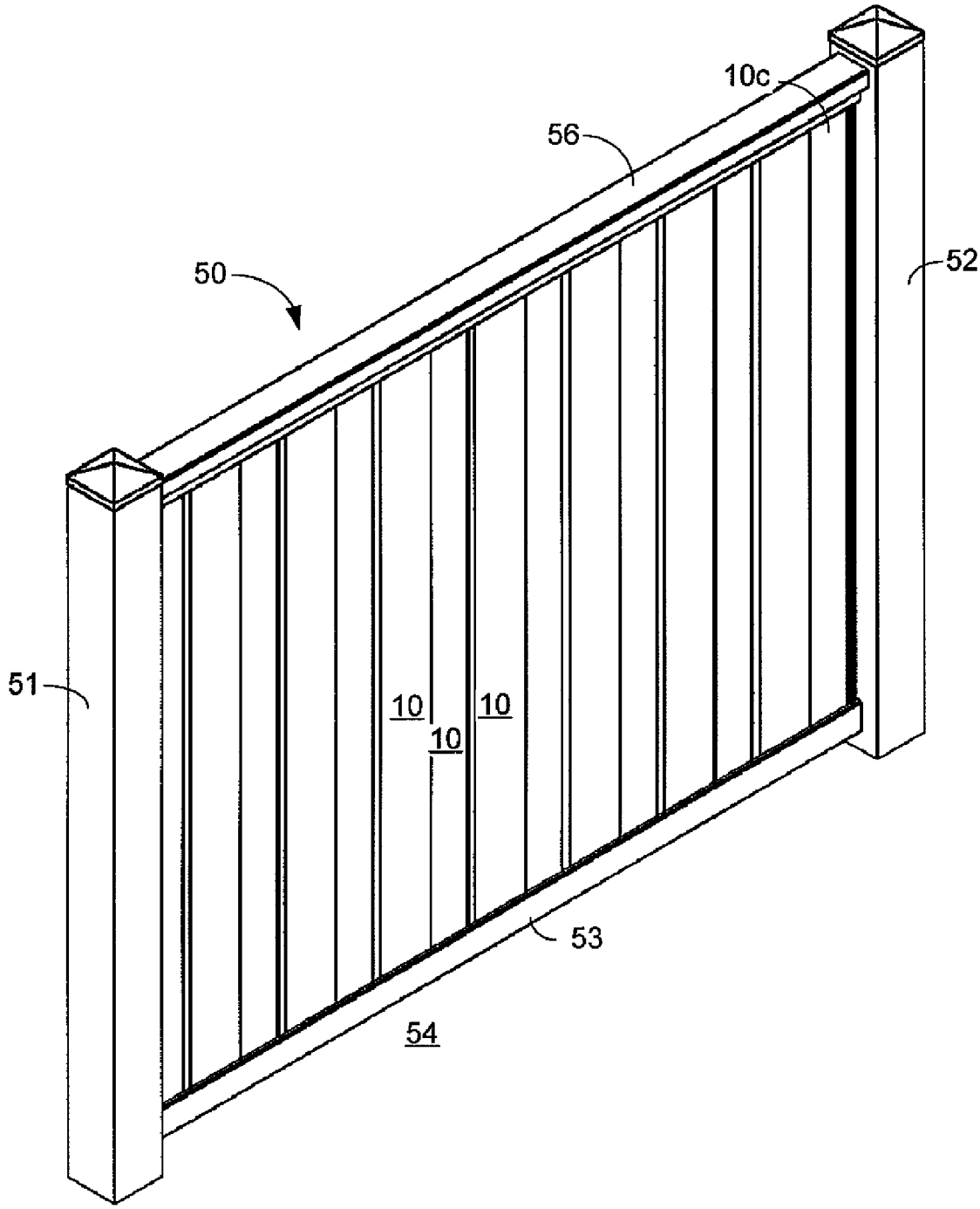
FIG. 14 is a perspective view of the partial fence portion of FIG. 13.

Referring to FIG. 14, a last panel 10*c* is installed in the manner described above and then affixed to the post 52. Then a top stringer 56 is installed on top of the plurality of panels 10 and connected to the posts 51 and 52.

This invention may be provided in other specific forms and embodiments without departing from the essential characteristics as described herein. The embodiment described is to be considered in all aspects as illustrative only and not restrictive in any manner.

As described above and shown in the associated drawings and exhibits, the present invention comprises a fence panel interlock. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. A fence, comprising:

a first panel comprising a planar main body comprising an inner surface and an opposing outer surface, and a first wall extending generally perpendicularly from the inner surface of the first panel at a lateral edge of the first panel, the first panel having a retaining recess on the inner surface of the first panel, the first wall having a first hook portion extending from the first wall concavely towards the inner surface of the first panel, the first hook portion and the retaining recess extending along a length of the first panel substantially parallel to the lateral edges of the first panel;

a second panel comprising a planar main body comprising an inner surface and an opposing outer surface, and a second wall extending generally perpendicularly from the inner surface of the second panel at a lateral edge of the second panel, the second wall comprising a second hook portion attached to the second wall and extending concavely towards the inner surface of the second panel and a protrusion located at an end of the second wall, the second hook portion and the protrusion extending along a length of the second panel substantially parallel to the lateral edges of the second panel, the first hook portion and the second hook portion engaged and the protrusion retained by the recess when the first panel is coupled to the second panel and the first wall and the second wall concealing the first and second hook portions, the recess, and the protrusion, wherein the outer surface of the first panel and the outer surface of the second panel are oriented in opposite directions.

2. A panel assembly comprising:

a plurality of generally rectangular panel members assembled in interlocking relationship, each panel member having a substantially flat planar main body, two side edges, a top edge, and a bottom edge, the planar main body comprising an inner panel surface and an outer panel surface, the two side edges comprising a first connector edge and a second connector edge, wherein the first connector edge and the second connector edge extend substantially perpendicularly from the inner panel surface of the main body at opposing lateral edges, and wherein the first connector edge comprises:

a substantially smooth outer surface extending generally perpendicular to the main body, and an inner surface comprising an inwardly-extending first hook concavely extending towards the inner panel surface, the first hook extending along a length of the main body substantially parallel to the lateral edges of the main body, and the second connector edge comprises:

a substantially smooth outer surface extending generally perpendicular to the main body and generally parallel to and in the same direction as the first connector edge, and an inner surface comprising an inwardly-extending second hook concavely extending towards the inner panel surface, and wherein the main body comprises a ledge wall extending from the inner panel surface and disposed adjacent to the second hook, the second hook and the ledge wall extending along a length of the main body substantially parallel to the lateral edges of the main body, and wherein a first panel member is engaged with a second panel member when the first hook of the first panel member is engaged with the second hook of the second panel member and when an outside edge of the first connector edge is restrained by the ledge wall, and wherein the outer panel surface of the first panel member and the outer panel surface of the second panel member are oriented in opposite directions.

3. The panel assembly of claim 2, wherein the inner panel surface of the main body further comprises a ramp disposed adjacent to the first hook.

4. The panel assembly of claim 3, wherein the ramp comprises a platform, and the first hook is fully engaged with the second hook when an outside edge of the second edge is disposed on a top surface of the platform.

5. The panel assembly of claim 2, wherein the first hook is substantially semi-circular and extends from the inner surface of the first connector edge and curves concavely toward the main body, and wherein the second hook is substantially semi-circular and extends from the inner surface of the second connector edge and curves concavely toward the main body.

* * * * *